United States Patent [19]

Burgard

[11] Patent Number: 4,660,538

[45] Date of Patent: Apr. 28, 1987

[54] INERTIAL STABILIZER FOR ARCHERY BOW

[76] Inventor: Francis A. Burgard, 12800 W. Cleveland Ave., New Berlin, Wis. 53151

[21] Appl. No.: 808,647

[22] Filed: Dec. 13, 1985

[51] Int. Cl.[4] ..... F41B 5/00

[52] U.S. Cl. ..... 124/89; 124/88; 124/24 R

[58] Field of Search ..... 129/89

[56] References Cited

U.S. PATENT DOCUMENTS 3,412,725 11/1968 Hoyt, Jr. ..... 124/89

4,245,612 1/1981 Finlay ..... 124/89

OTHER PUBLICATIONS

Bow and Arrow Saunders, *Noise Busters,* Oct. 1985, p. 19.

*Primary Examiner*—Richard C. Pinkham

*Assistant Examiner*—Gary Jackson

*Attorney, Agent, or Firm*—Bayard H. Michael

[57] ABSTRACT

The stabilizer has the threaded end of a mounting bolt projecting from a tube. The bolt head is inside the tube. A spring is compressed between the bolt head and a seat bearing against a shoulder surrounding the opening through which the bolt projects. An adjusting nut on the bolt bears against a bumper bearing on the other side of the shoulder. Adjusting the nut adjusts the spring force to vary the effect generally to match the draw weight of the bow. A lead weight is press-fit in the open end of the tube which is closed by a plastic plug or, in the alternative, by an adapter into which a supplemental weight is screwed or a "tracker" is screwed.

7 Claims, 5 Drawing Figures

INERTIAL STABILIZER FOR ARCHERY BOW

BACKGROUND OF THE INVENTION

Inertial stabilizers for archery bows are old. They generally mount a weight forward of the bow with means allowing relative movement between the weight and bow with a spring to restore the parts to original position. The devices are either not adjustable to different "draw weights" of the bows or are adjusted only with difficulty.

SUMMARY OF THE INVENTION

This invention provides a stabilizer which is easily adjusted to the bow on which it is mounted. The design is very "clean" and can be adapted to additional functions or to extend the adjusting range.

The device has the threaded end of a mounting bolt projecting from a tube. The bolt head is inside the tube. A spring is compressed between the bolt head and a seat bearing against a shoulder surrounding the opening through which the bolt projects. An adjusting nut on the bolt bears against a bumper bearing on the other side of the shoulder. Adjusting the nut adjusts the spring force to vary the effect generally to match the draw weight of the bow. A lead weight is press-fit in the open end of the tube which is then closed by a plastic plug or, in the alternative, by an adapter into which a supplemental weight is screwed or a "tracker" is screwed.

DETAILED DESCRIPTION OF THE DRAWINGS

Figure 1:
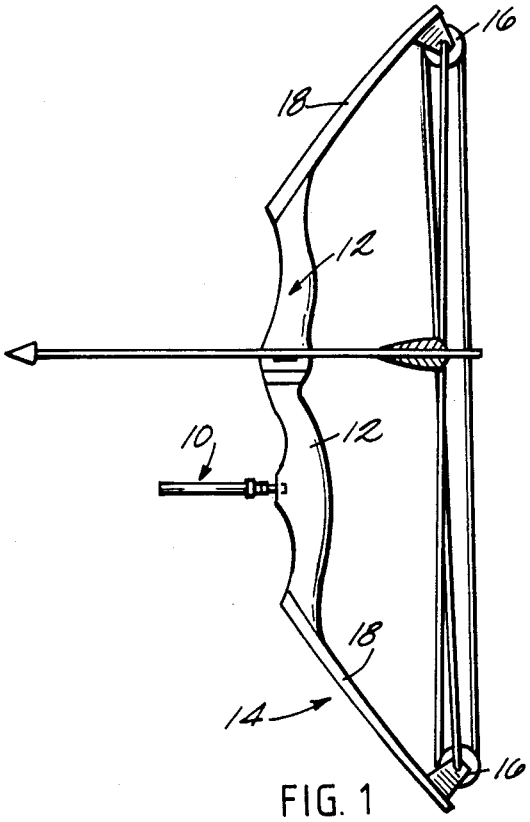
FIG. 1 shows the vibration damping device mounted on a compound bow.
Figure 3:
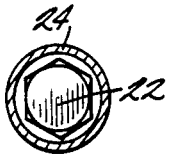
FIG. 3 is a section on line 3—3 in FIG. 2.

The stabilizer 10 is mounted on the riser section 12 of the bow 14 which is a typical compound bow provided with eccentric pulleys 16 and a bow string or cable reeved over the pulleys so as to decrease the draw weight of the bow as the bow is drawn. Thus, a 60 pound bow requires 60 pounds to start the pull, but only about 30 pounds to hold the bow at full draw. Upon release, the arrow is accelerated gradually (relatively) and the casting force becomes 60 pounds. The compound bow has permitted archers to move to higher drawweight bows and at the same time has encouraged use of cable sections in the bow string arrangement. The net result is that when the arrow is cast (the bow string approximately in the position shown in FIG. 1) the tips of the limbs 18 of the bow are moving quite rapidly and are suddenly brought to an abrupt halt by the cable going taught. That amount of energy can't just disappear; the energy transfers to the riser section and moves the riser back relative to the bow tips. This impacts in the archer's palm and also causes a fair amount of noise. Bow stabilizers or dampers are intended to minimize this kickback or vibration.

Figure 2:
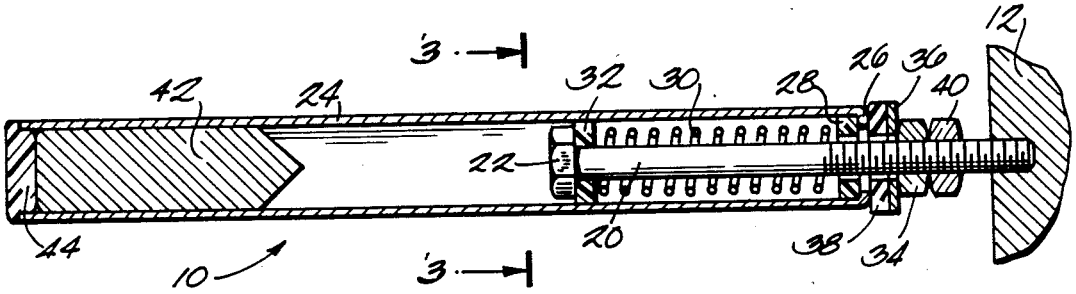
FIG. 2 is a vertical section through the damping device.
Figure 4:
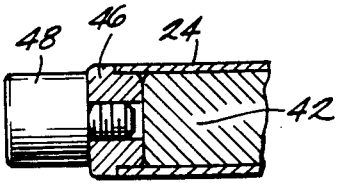
FIG. 4 is an alternative treatment of the end of the damping tube. In this view an adapter permits an additional weight to be mounted.
Figure 5:
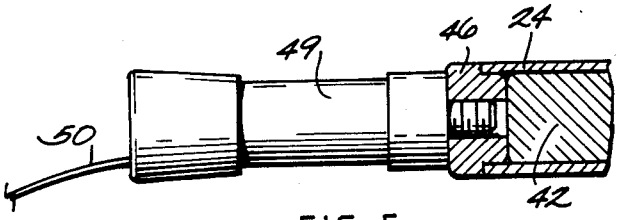
FIG. 5 shows a tracking device screwed into the adapter.

The stabilizer 10 is threaded into the riser section 12 as indicated in FIG. 2. The stabilizer has bolt 20 having its threaded end turned into the riser 12. The bolt head 22 is inside the aluminum tube 24 and is mounted from the left in FIG. 2. The right end of the tube 24 is turned in to provide a shoulder 26 against which the Nylon washer 28 seats. Spring 30 is compressed between washer 28 and washer 32 bearing against the bolt head 22. The spring 30 biases the tube 24 towards the riser 12 and the motion of the tube towards the riser is limited by adjusting nut 34 threaded on the bolt and bearing against the steel washer 36 and the annular rubber bumper or washer 38. Lock nut 40 is turned against nut 34 to hold it in its adjusted position. Spring 30 pushes the washer 28 against the shoulder 26 to push the tube and the washer against bumper 38 and then the steel washer 36 and nut 34.

The more nut 34 is turned towards the left, the more spring 30 will be compressed. This permits the compression of spring 30 to be matched to the bow draw weight or force. The spring can be adjusted to accommodate a bow draw weight between 35 and 80 pounds. When shipped from the factory, nut 34 is adjusted for a 70 pound draw weight. The nut is backed off one thread for each 5 pound reduction desired until the 35 pound minimum is reached. That will still leave enough thread on the bolt to properly mount the stabilizer on the riser. There is no hard and fast rule as to the "match" of the spring and pull. The user ultimately will set the spring for what feels best and what setting gets the best results by way of accuracy.

The left end of the stabilizer or damper 10 has a lead weight 42 mounted in the open end of the tube by a press fit. A plastic plug 44 is mounted in the open end. The lead weight 42 has substantial weight and, therefore, substantial inertia.

When the arrow is cast and the riser tends to kick back against the user's hand. The lead weight 42 and the associated tube 24 want to stay in the same place in space while the riser 12 moves to the right and compresses spring 30. After the shock is past, the spring 30 returns the parts to the positions shown. The shock reduction can be felt (or not felt) by the archer. There is an appreciable reduction in sound.

If desired, a thicker closure plug 46 having a threaded bore can be used. This permits mounting a supplemental weight 48 for those desiring greater damping effect.

The supplemental fitting 46 also permits mounting a tracker 48. This tracker is one such as shown in my application Ser. No. 676,482, filed Nov. 29, 1984 and includes a colored tracking string 50 which is secured to an arrow before it is shot. The arrow then pulls string out. This enables the game to be tracked more readily.

I claim:

1. A stabilizer for an archery bow, comprising, a tube having an inturned end forming a shoulder around a central opening, a bolt having its head inside said tube and its threaded end projecting through said central opening, a spring compressed between said shoulder and said bolt head, an adjusting nut threaded on said bolt outside said tube to adjust the compression of said spring, and a weight mounted in the other end of said tube.

2. A stabilizer according to claim 1 including a lock nut threaded on said bolt to bear against said adjusting nut.

3. A stabilizer according to claim 2 including a resilient washer between said shoulder and said adjusting nut.

4. A stabilizer according to claim 3 including a metal washer between said resilient washer and said adjusting nut.

5. A stabilizer according to claim 4 in which said spring is a coil spring and bearing against an annular seat at each end of the spring.

6. A stabilizer according to claim 5 mounted on and projecting forwardly from the riser section of an archery bow so said spring is compressed when an arrow is released and the spring thereafter restores the parts to their normal position, said adjusting nut being adjusted along said threaded end of the bolt to generally match the spring force to the draw weight of the bow.

7. A stabilizer according to claim 2 including an end closure member fitting in said other end of said tube and having a threaded bore therein enabling mounting of auxiliary devices therein.

* * * * *